United States Patent [19]

Bromboz

[11] 4,366,592

[45] Jan. 4, 1983

[54] BRUSHES AND METHOD OF MAKING SAME

[76] Inventor: Jonathan J. Bromboz, 11 Chaparral Ct., Novato, Calif. 94947

[21] Appl. No.: 175,931

[22] Filed: Aug. 6, 1980

[51] Int. Cl.[3] ..... A46B 9/04; A46D 3/00

[52] U.S. Cl. ..... 15/22 R; 15/167 A; 15/27; 15/DIG. 5; 300/21; 264/243

[58] Field of Search ..... 15/167 R, 167 A, 22 R, 15/27, 180, DIG. 5, 225; 300/2, 4, 5, 7, 8, 9, 21; 264/243

[56] References Cited

U.S. PATENT DOCUMENTS

| | | | |
|---|---|---|---|
| 1,259,571 | 3/1918 | Wiens | 300/21 |
| 2,282,700 | 5/1942 | Bobbroff | 15/22 R |
| 2,284,200 | 5/1942 | Gruss | 15/167 A |
| 2,310,186 | 2/1943 | Abrams | 300/21 X |
| 3,903,906 | 9/1975 | Collis | 15/167 A |

FOREIGN PATENT DOCUMENTS

| | | | |
|---|---|---|---|
| 17005 | of 1910 | United Kingdom | 15/27 |

*Primary Examiner*—Peter Feldman

*Attorney, Agent, or Firm*—Emrich, Lee, Brown & Hill

[57] ABSTRACT

Brushes and the method of making the same by first forming a strip embodying a backing sheet with bristles disposed on one face thereof in parallel relation to each other and with ends projecting outwardly from one longitudinal edge of the strip; forming the strip into a predetermined shape; securing the aforementioned bristle ends in a base; and removing the backing sheet from the bristles.

50 Claims, 42 Drawing Figures

BRUSHES AND METHOD OF MAKING SAME

BACKGROUND OF THE INVENTION

This invention relates to brushes and the method of making same.

A primary object of the present invention is to afford a novel brush and a novel method of making such a brush.

Another object of the present invention is to enable novel toothbrushes to be made in a novel and expeditious manner.

A further object of the present invention is to enable brushes, embodying individual bristles spaced from each other along rows, to be produced in a novel and expeditious manner.

Another object is to afford a novel method of making brushes, whereby elongated strips, embodying backing sheets carrying spaced individual bristles thereon, may be formed into desired shapes or patterns prior to mounting the bristles in operative position on bases, and, after so mounting the bristles on bases, the backing sheets may be removed to expose the bristles in position for use.

Another object of the present invention is to afford a novel method of making brushes having individual bristles disposed in spaced relation to each other along rows, and wherein adjacent bristles in the rows are of different length.

Another object of the present invention is to afford a novel brush.

A further object is to afford a novel toothbrush.

Toothbrushes, of course, have been long known in the art. However, toothbrushes heretofore known in the art have had several inherent disadvantages, such as, for example, being inefficient or ineffective in the removal of plaque from the teeth; being injurious to the gums and delicate tissues of the mouth; not being effective to reach and thoroughly clean certain areas in the mouth, such as, for example, the deep recesses between the teeth, the cracks, crevices, grooves and inter-proximal spaces in and between the teeth, and under the gum line, and the like. It is an important object of the present invention to overcome such disadvantages.

Another object of the present invention is to afford a novel toothbrush wherein, in the use thereof, the bristles are effective to envelop the teeth being brushed in an effective manner.

Another object is to afford a novel toothbrush which, in the use thereof, is effective to remove plaque from the teeth.

A further object is to afford a novel toothbrush, embodying soft and flexible mounting portions for the bristles thereof, which mounting portions are effective to protect the bristles from bending fatique and which, also, are effective to protect the mouth against injury.

Another object of the present invention is to afford a novel toothbrush embodying oppositely disposed brushes for cleaning the opposite sides of the teeth and another brush disposed between the oppositely disposed brushes for cleaning the biting surfaces of the teeth.

Yet another object of the present invention is to afford a novel toothbrush of the aforementioned type wherein the brushes are articulated, in a novel and expeditious manner, for movement into proper tooth-cleaning position during movement of the brush around the mouth of the person using the same.

A further object of the present invention is to afford a novel toothbrush embodying individual, spaced bristles.

Another object of the present invention is to afford a novel toothbrush of the aforementioned type wherein the bristles are disposed in a row with adjacent bristles in the row being of different length.

Another object of the present invention is to afford a novel toothbrush of the aforementioned type, wherein the head portion thereof may be mounted on a manually actuated handle or on a power driven handle.

A further object of the present invention is to afford a novel toothbrush of the aforementioned type which is practical and efficient in operation, and which may be readily and economically produced commercially.

Another object of the present invention is to afford a novel method of manufacturing toothbrushes, and the like, which method is practical and efficient and lends itself to economical, commercial use.

Other and further objects of the present invention will be apparent from the following description and claims and are illustrated in the accompanying drawings which, by way of illustration, show preferred embodiments of the present invention and the principles thereof and what I now consider to be the best mode in which I have contemplated applying these principles. Other embodiments of the invention embodying the same or equivalent principles may be used and structural and other changes may be made as desired by those skilled in the art without departing from the present invention and the purview of the appended claims.

DESCRIPTION OF THE EMBODIMENTS SHOWN HEREIN

In FIGS. 1–24, inclusive, a method of making brushes in accordance with the principles of the present invention, is illustrated to illustrate the presently preferred embodiment of the present invention.

Figure 5:
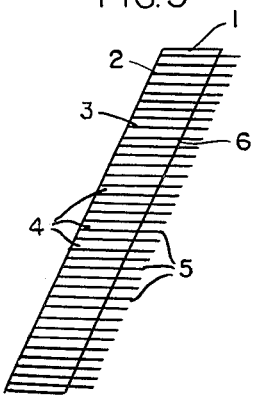
Figure 7:
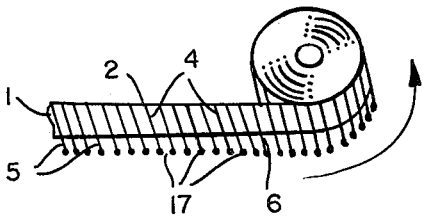
FIG. 7 is a perspective view of a strip of the type shown in FIG. 6, with the strip being formed into a spiral pattern.
Figure 8:
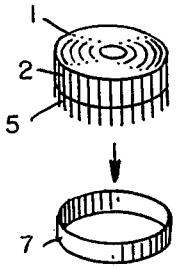
FIGS. 8 and 9 are views illustrating the successive steps in mounting a strip of the type shown in FIG. 7 in a mold.
Figure 9:
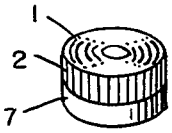
Figure 10:
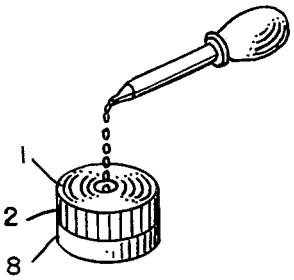
FIGS. 10 and 11 are perspective views illustrating the removal of backing sheet material from the strip after removal from the mold shown in FIGS. 8 and 9.
Figure 11:
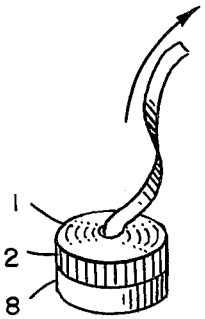
Figure 12:
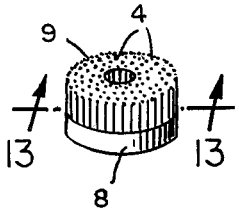
FIG. 12 is a perspective view of a completed brush.
Figure 13:
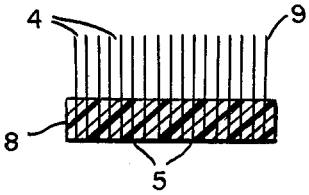
FIG. 13 is a transverse cross-sectional view taken substantially along the line 13—13 in FIG. 12.

Basically, the aforementioned method may be considered to comprise affording an elongated strip 1 embodying an elongated backing sheet 2 having a suitable adhesive, such as, for example, an acrylic adhesive, on one face 3 thereof, with bristles 4 extending transversely across the face 3 of the backing sheet 2 and secured thereto by the aforementioned adhesive, in preferably parallel, spaced relation to each other, and with free end portions 5 of the bristles 4 projecting outwardly from one longitudinal edge 6 of the backing sheet 2, as shown in FIG. 5; forming the strip 1 into a desired shape, such as, for example, a spiral, as shown in FIG. 7; placing the strip 1 in a suitable mold 7, as shown in FIGS. 8 and 9, to secure a base 8 to the free end portions 5 of the bristles 4, FIGS. 10 and 11; removing the backing sheet 2 from the bristles 4, as illustrated in FIGS. 10 and 11, to thereby afford a brush 9 having the now free bristles 4 projecting outwardly from the base 8, which is secured to the end portions 5, FIGS. 12 and 13, as will be discussed in greater detail hereinafter.

Figure 4:
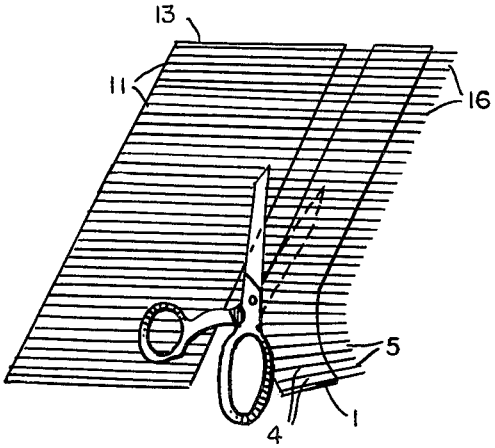

In the method of forming the strip 1, shown in the drawings, elongated filaments 11, from which the aforementioned bristles 4 are to be subsequently formed, are disposed in the aforementioned parallel, spaced relation on the adhesively coated face 12 of a larger, elongated backing sheet 13 in transversely extending relation to the latter, FIG. 1; starting at one longitudinal edge 14 of the sheet 13, parallel spaced strips 15 are cut from the backing strip 13, without cutting the filaments 11, FIG. 2, and the strips 15 are then removed from the backing sheet 13 to expose the portions 16 of the filaments 11 which will subsequently form the free end portions 5 of the bristles 4 on the strips 1, formed from the larger sheet 13; the strips 1 are then severed from the sheet 13, FIG. 4, to thereby afford the aforementioned elongated strips 1, as shown in FIG. 5.

Figure 6:
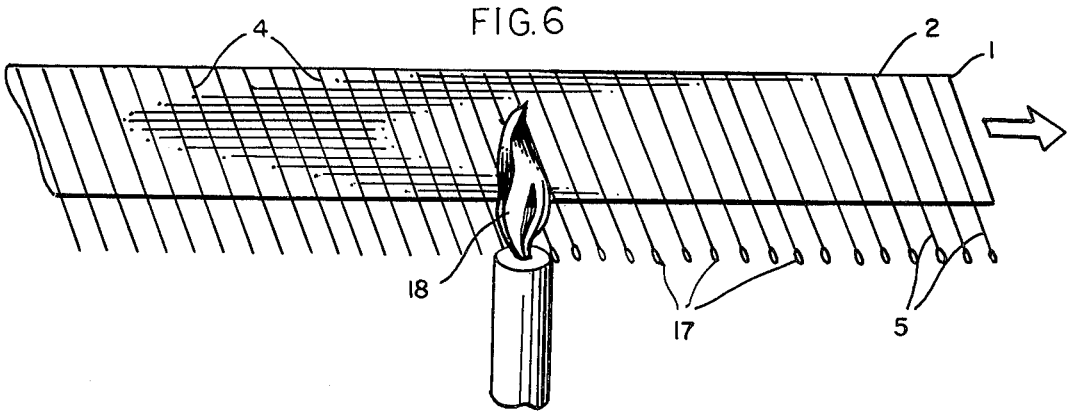
FIG. 6 is a top view, similar to FIG. 5, but illustrating a method of forming enlarged portions on the brush bristles.

Preferably, thereafter, enlarged portions 17 are formed on the extreme outer ends of the free end portions 5 of the bristles 4, by passing them through a suitable heating medium, such as a flame 18, FIG. 6, prior to disposing the sheet 1 in the desired shape, such as the aforementioned spiral, FIG. 7.

The mold 7 into which the shaped strip 1 is to be placed preferably is of such size and shape as to freely but snugly receive the shaped strip 1 therein. Prior to insertion of the shaped strip 1 into the mold 7, the mold 7 is filled to a predetermined level with a suitable liquid material, such as a suitable elastomeric material, such as, for example, silicone, which will solidify to afford the base 8 of the brush 9. Preferably, the level of the liquid material in the mold 7 is such that the top thereof is disposed in closely adjacent, downwardly spaced relation to the backing sheet 2, so that, when the liquid material solidifies, only the free end portions 5 of the bristles 4 are embedded in the resulting base 8.

After the liquid material has solidified into the base 8, a suitable solvent, such as, for example, methyl alcohol, may be applied to the upper portion of the strip 1, FIG. 10, to loosen the backing sheet 2 from the bristles 4, and the backing sheet 2 may then be stripped from the bristles 4, FIG. 11, to afford the brush 9, FIGS. 12 and 13, having free bristle portions 4 projecting from the base 8, and with the end portions 5 of the bristles 4 embedded in the base 8. The enlargement 17 on the free end portions 5 afford an effective interlock with the base 8 for preventing accidental removal of the bristles 4 from the latter.

Figure 14:
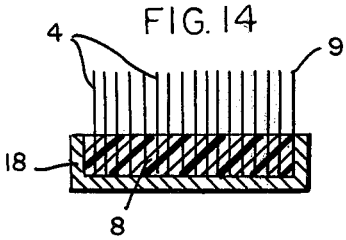
FIG. 14 is a transverse cross-sectional view, similar to FIG. 13, but showing the brush mounted in an outside housing or cover member.

As will be discussed in greater detail hereinafter, when the brush 9 is to be used in a toothbrush, or the like, the base 8 preferably is formed from a suitable yieldable, resilient material, such as, the aforementioned silicone. However, if the brush 9 is to be used for other purposes, such as, for example, as a fingernail brush, or the like, the base 8 may be made of other suitable material, such as, for example, a suitable epoxy resin or polyvinyl chloride, or the like, or, if desired, the base 8 may be made of the aforementioned yieldable, resilient material and be disposed in an outer housing 18, as shown in FIG. 14, made from a suitable hard material, such as, for example, wood, metal or a suitable plastic, such as, for example, the aforementioned polyvinyl chloride, or the like.

Figure 15:
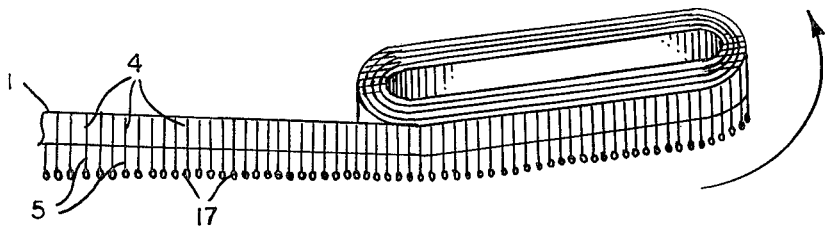
FIG. 15 is a view similar to FIG. 7, but showing the strip being formed into an oblong shape.
Figure 16:
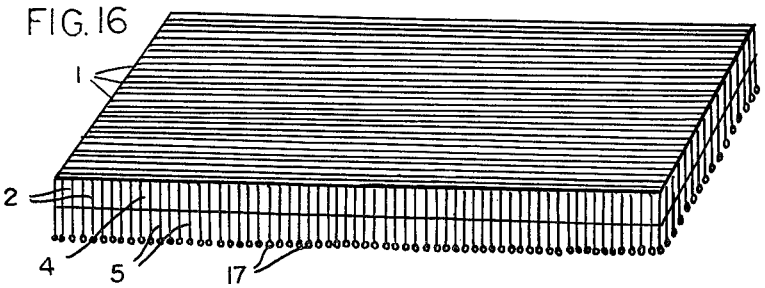
FIG. 16 is a view similar to FIG. 7, but showing a plurality of strips being disposed in a rectangular pattern.

Brushes having shapes other than the substantially circular shape of the brush 9, shown in FIGS. 12 and 13, may be made without departing from the broader aspects of the present invention by disposing the strips 1 in shapes other than the spiral shape shown in FIG. 7 prior to disposing the strips 1 in the molds for securing material to the free end portions 5 of the bristles 4. For example, if desired, the strip may be rolled into an oblong shape, as shown in FIG. 15; or a plurality of strips 1 may be disposed in side-by-side parallel relation to each other, as shown in FIG. 16, to afford a rectangular-shaped brush in the final product.

Figure 17:
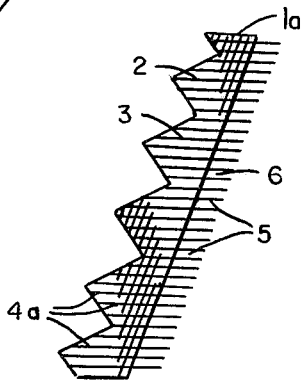
FIG. 17 is a view similar to FIG. 5, but showing one longitudinal edge portion of the strip being cut into a zig-zag pattern.
Figure 18:
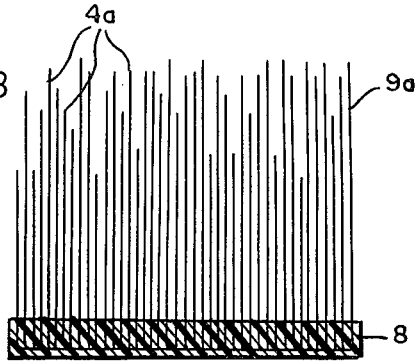
FIG. 18 is a view similar to FIG. 13, but showing the brush construction resulting from the use of a strip of the type shown in FIG. 17.

Also, if desired, brushes in which adjacent bristles project different distances from the base thereof, rather than projecting the same distance, as shown in FIGS. 12 and 13, may also be readily afforded, utilizing the principles of the present invention. For example, if a strip 1*a* having the longitudinal edge thereof, opposite to the longitudinal edge 6 cut in a zig-zag pattern, as shown in FIG. 17, is formed instead of the strip 1, shown in FIG. 5, wherein the longitudinal edge thereof opposite from the longitudinal edge 6 is in parallel relation to the latter, when the backing sheet 2 is removed from the strip 1*a*, after the end portions 5 of the strands 4*a* are disposed in the base 8 of the brush 9*a*, FIG. 18, adjacent ones of the bristles 4*a* project from the base 10 different distances, as shown in FIG. 18. This, as will be discussed in greater detail presently, is the presently preferred form of brush construction for use in toothbrushes, and the like, and, as will be seen by those skilled in the art, my aforementioned method of forming brushes readily adapts itself to the affording of such brush construction.

Figure 19:
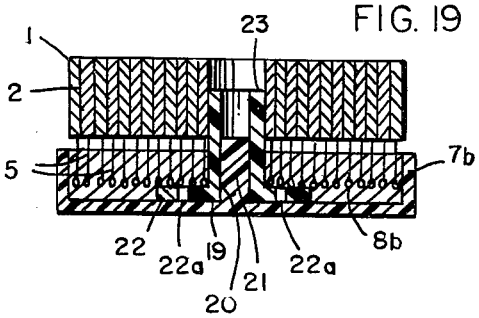
FIG. 19 is a transverse cross-sectional view through a strip and mold, corresponding to the perspective view shown in FIG. 9, but illustrating the mounting of a reinforcing member in the strip.
Figure 20:
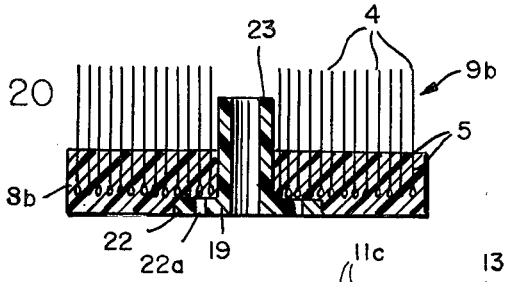
FIG. 20 is a transverse cross-sectional view, corresponding to FIG. 13, but showing the brush resulting from the molding process illustrated in FIG. 19.

In FIGS. 19 and 20 a modification of the method illustrated in FIGS. 1–13 is shown, and parts which are the same as parts shown in FIGS. 1–13 are indicated by the same reference numerals, and parts which are similar to parts shown in FIGS. 1–13 but differ therefrom are indicated by the same reference numerals with the suffix "b" added thereto.

In FIGS. 19 and 20, a method of making brush 9*b*, which embodies a reinforcing member 19 mounted in the base 8*b*, with an opening 20 extending centrally through the reinforcing member 19 and the central portion of the base 8*b* is illustrated.

The mold 7*b* is of the same general size and shape as the mold 7 shown in FIG. 9, but has a pin 21 projecting upwardly from the central bottom portion thereof. Prior to inserting the strip 1 in the mold 7*b*, the reinforcing member 19, which may be made of any suitable material, such as, for example, flexible rubber, and which embodies a substantially flat, annular, bottom disk 22 from the central portion of which a sleeve 23 projects upwardly is mounted in the mold 7*b* with the pin 21 projecting upwardly through the disk 22 into the sleeve 23. Preferably, the disk 22 has a plurality of spaced openings 22*a* extending therethrough.

With the reinforcing member 19 thus disposed in the mold 7*b*, the free end portions 5 of the bristles 4 rest on the upper face of the disk 22 when the strip 1 is disposed in operative position in the mold 7*b*, FIG. 19. The liquid material is then poured into the mold 7*b* and flows around the disk 19 and into the opening 20*a* therein. After the liquid material has been poured into the mold 7*b* and permitted to set, the resulting brush 9*b*, when removed from the mold 7*b*, embodies the reinforcing member 19 embedded in and secured to the base 8*b*, with the sleeve 23 projecting upwardly from the base 8*b* into the central portion of the bristles 4, FIG. 20. This constitutes what I presently prefer to use as a form of brush in toothbrushes, and the like, which will be discussed in greater detail presently. However, as will be appreciated by those skilled in the art, reinforcing members of various different sizes and shapes and made of various materials may be inserted into the base of a brush, such as the base 8*b* of the brush 9*b*, without departing from the purview of the broader aspects of the present invention.

Figure 21:
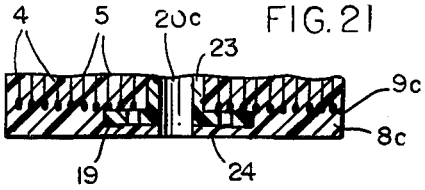
FIG. 21 is a fragmentary, transverse cross-sectional view, similar to FIG. 20, but showing a modified form of the brush shown in FIG. 20.

In FIG. 21 a modification of the aforementioned method of making a brush embodying the insert 19 of the brush 9*b*, shown in FIGS. 19 and 20, is illustrated. In this method, a mold 7 having the same construction as the mold 7 shown in FIG. 9 is used, and prior to insertion of the reinforcing member 19 thereinto, a layer 24 of the aforementioned liquid material is placed into the mold 7 and permitted to solidify to such an extent that, when the reinforcing member 19 is placed in the mold 7 the reinforcing member 19 rests on top of the layer 24. Thereafter, the balance of the material forming the base 8*c* may be poured into the mold 7 and permitted to solidify to thereby afford a base wherein the reinforcing member 19 is completely embedded therein. If desired, the portion of the material 24 in axial alignment with the opening 20*c* in the sleeve 23 of the reinforcing member 19 may be removed to thus afford a brush 9*c* having an opening passing completely through the center thereof.

Figure 1:
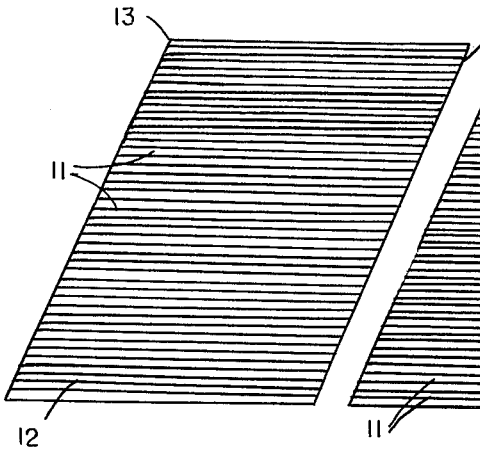
FIG. 1 is a top view of a backing sheet having filaments mounted thereon, illustrating one of the initial steps of my novel method of making brushes.
Figure 2:
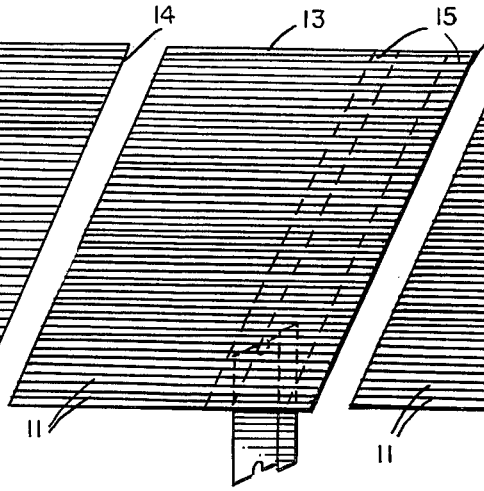
FIGS. 2, 3, 4 and 5 are views similar to FIG. 1, but illustrating successive subsequent steps in my aforementioned method.
Figure 3:
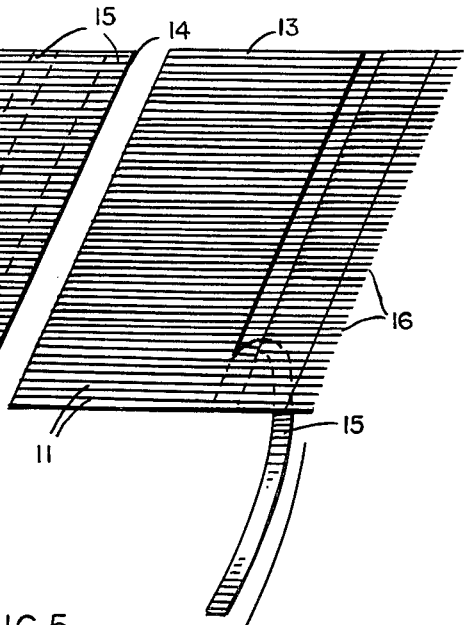
Figure 22:
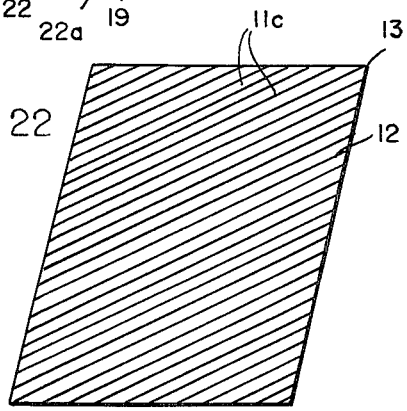
FIGS. 22 and 23 are views corresponding to FIGS. 1 and 5, respectively, but illustrating a modified form of the present invention.
Figure 23:
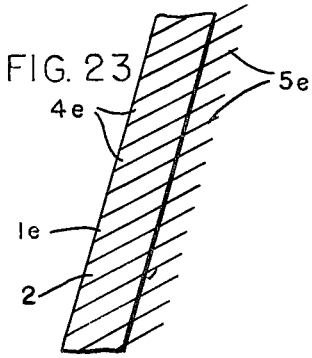

If desired, instead of placing the strands 12 in perpendicular relation to the length of the backing sheet 13, as shown in FIG. 1, strands such as strands 11*e* may be disposed on the backing sheet 13 in a different position, such as, for example, at an acute angle to the length thereof, as shown in FIG. 22. As will be appreciated by those skilled in the art, when a strip, such as the strip 1*e*, shown in FIG. 23, is formed from such a larger backing strip 13, the bristles 4*e*, including the free end portions 5*e* thereof, are disposed at an acute angle to the length of the strip 1*e* so that when a brush is formed in the same manner as heretofore discussed with respect to the strip 1, the bristles of the completed brush are disposed at an acute angle relative to the base thereof.

Figure 24:
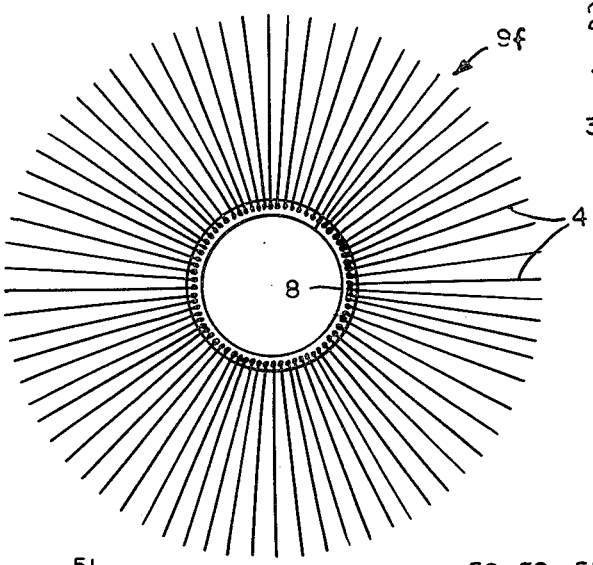
FIG. 24 is a transverse cross-sectional view through a tubular brush made in accordance with the principles of the present invention.

In FIG. 24 a brush 9*f* is shown, which is tubular in shape and has the bristles 4 thereof projecting radially outwardly from a base 8, which has been rolled into a tubular shape. Such a brush 9*f* may be readily made in accordance with the principles of the present invention, by first forming a rectangular shaped brush in the manner heretofore discussed with respect to FIG. 16, and then, after removing the backing strips 2 therefrom, rolling the brush either around its longitudinal axis or transverse axis into a tubular shape, with the base 8 defining the inner portion thereof, and with the bristles 4 projecting radially outwardly from the base 8; cementing, or otherwise securing the abutting edges of the base 8 together; and then transversely severing the elongated tubular member into the length desired for the brush 9*f*.

From the foregoing it will be seen that the present invention affords a novel method for manufacturing brushes.

A toothbrush 30, embodying the principles of the present invention is shown in FIGS. 25–36 and 41 of the drawings to illustrate the presently preferred structural embodiment of the present invention.

Figure 25:
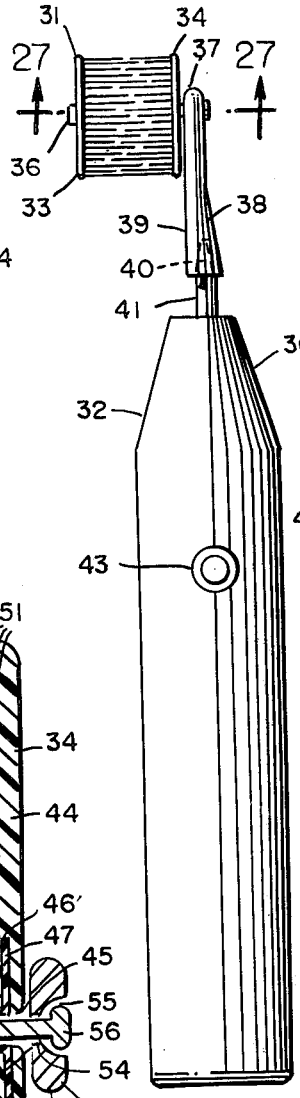
FIG. 25 is a front elevational view of a toothbrush embodying the principles of the present invention.
Figure 26:
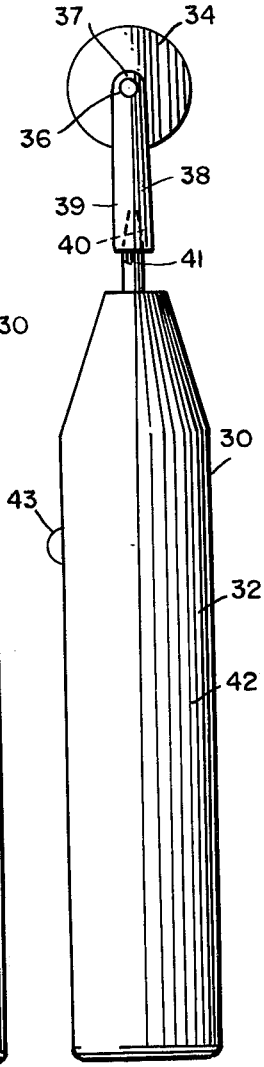
FIG. 26 is a side elevational view of the toothbrush shown in FIG. 25.

The toothbrush 30 embodies a head 31 mounted on a handle 32, FIGS. 25 and 26. The head 31 embodies three brushes 33, 34 and 35, FIG. 27, rotatably mounted on a shaft 36, one end of which is rotatably and pivotably mounted in the upper end portion 37 of an adapter 38, FIGS. 25–27. The lower end portion 39 of the adapter 38 has an elongated recess 40 projecting upwardly thereinto, FIGS. 25 and 26, the recess 40 being of such size and shape as to receive the upper end portion of a shaft 41, projecting upwardly from the top of the main body portion 42 of the handle 32, with a snug, fictional fit effective to removably mount the adapter 38 on the handle 32.

The handle 32 is a power-unit, embodying mechanism in the body portion 42 effective to vibrate the shaft 41. It may be of any suitable type, readily available on the market, such as, for example, the type shown in U.S. Pat. No. 3,978,852, wherein the shaft, corresponding to the shaft 41 is vibrated laterally; or of the type shown in U.S. Pat. No. 2,290,454, wherein the shaft corresponding to the shaft 41 is vibrated longitudinally; or of the type shown in U.S. Pat. Nos. 2,601,567 or 2,917,758, wherein the shaft corresponding to the shaft 41 is oscillated around the longitudinal axis thereof. A suitable control, such as a push button switch 43 is embodied in the handle 32 for manually controlling the operation of the drive mechanism embodied in the body portion 42 thereof.

The brushes 33 and 34 on the head 31 are identical in construction. Each embodies a substantially round, disk-shaped base portion 44 made of a soft, flexible, resilient material, such as a suitable elastomer, such as, for example, silicone, having a transverse opening 45 extending through the center thereof. A reinforcing member 46 is mounted in each of the bases 44. Each of the reinforcing members 46 embodies a substantially disk-shaped, annular body portion 47 embedded in the respective base 44, in concentric relation to the respective opening 45, with a tubular portion 48 projecting inwardly therefrom, a passageway 49 extending through each of the body portions 47 and the adjacent tubular portion 48.

Figure 27:
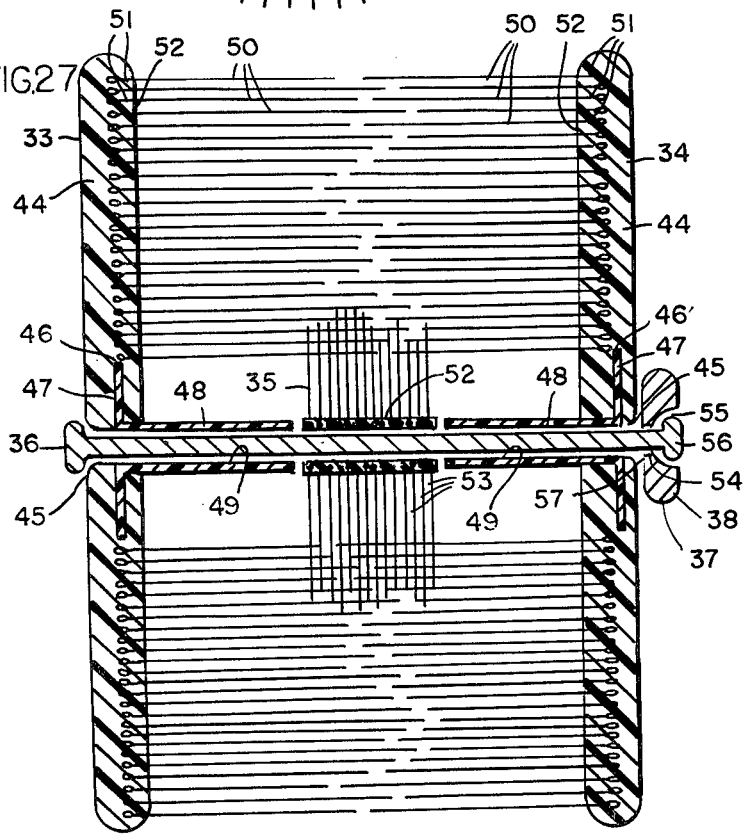
FIG. 27 is a transverse cross-sectional view taken substantially along the line 27—27 in FIG. 25.
Figure 28:
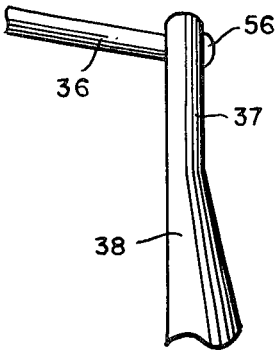
FIGS. 28 and 29 are fragmentary, front elevational views of a portion of the brush shown in FIG. 27, illustrating the relative movement of certain portions of the brush.
Figure 29:
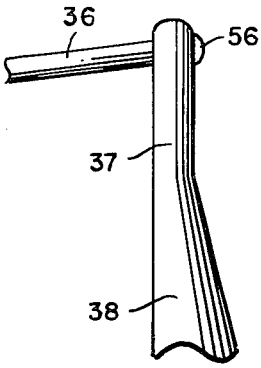
Figure 30:
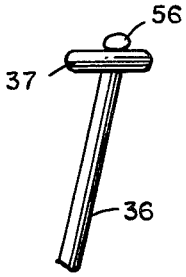
FIGS. 30 and 31 are fragmentary top views of the portions of the brush shown in FIGS. 28 and 29, but illustrating other relative movements of portions of the brush.
Figure 31:
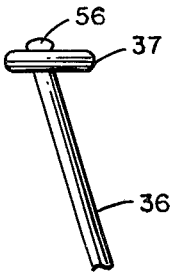

Each of the brushes 33 and 34 embodies bristles 50, having end portions 51 embedded in the respective bases 44, with the bristles 50 projecting from one face 52 of the respective base 44 in surrounding relation to the tubular portion 48 of the reinforcing member 46 disposed in the respective base 44, FIG. 27.

The brushes 33 and 34 preferably are constructed in the manner heretofore discussed with respect to FIGS. 17 and 18, so that adjacent bristles 50 project from the respective bases 44 different distances. The bristles 50 may be of any suitable size and shape, and may be made of any suitable material, without departing from the broader aspects of the present invention, but preferably are made of nylon and have a diameter of between 0.006 and 0.008 inches, and preferably in the nature of 0.007 inches; with the exposed portions thereof projecting from the respective bases 44 a distance varying from five millimeters to fifteen millimeters; and with adjacent bristles along the strip from which the brushes are constructed being spaced from each other a distance in the nature of 0.2 millimeters to 0.4 millimeters and, preferably, 0.3 millimeters.

The brush 35 is of the type shown in FIG. 24, embodying a tubular body portion 52, preferably made of a soft, resilient flexible material, such as, for example, silicone, and having bristles 53 projecting radially outwardly therefrom. The bristles 53 also may be made of any suitable material and of any suitable size and spacing, but, preferably, are made of nylon; having a diameter of between 0.006 and 0.008 inches, and, preferably, 0.007 inches; have a length varying from 3 millimeters to 10 millimeters; and are spaced from each other circumferentially and longitudinally of the base 52 between 0.2 millimeters and 0.4 millimeters, and preferably in the nature of 0.3 millimeters.

The brushes 33–35 are mounted on the shaft 36 with a relatively snug, but freely rotatable fit, with the brushes 33 and 34 disposed on opposite sides of the brush 35 with the bristles 50 thereof facing toward each other. Preferably, the head 31 is of such size that, when the free end portions of the tubular portions 48 of the reinforcing member 46 are disposed in abutting engagement with opposite ends of the base 52 of the brush 35, the free ends of the longest bristles 50 of the brushes 33 and 34 are disposed in substantially uniplanar relation to each other. Also, preferably, the bristles 53 of the brush 35 are of such length that, the longest bristles 53 extend into abutting engagement with, and between the radially innermost bristles 50 of the brushes 33 and 34 when the brushes 33–35 are disposed in normal, at rest position on the shaft 36.

It will be remembered that the shaft 36 extends through the upper end position 37 of the adapter 38, FIGS. 25–27. In the preferred form of the present invention, the opening 54, through which the shaft 36 extends in the adapter 38 has a semi-spherical recess 55, FIG. 27, which is complementary in size and shape to the end portion 56 of the shaft 36 disposed at the side of the head 31. Also, the inner end portion 57 of the opening 54, in the preferred form of the present invention, is of sufficiently larger size than the radially adjacent portion of the shaft 36 that the head portion 56 of the 36 may oscillate in the recess 55 to dispose the shaft 36 at various acute angles relative to the adapter 38, as illustrated somewhat diagrammatically in FIGS. 28–31, for a purpose which will be discussed in greater detail hereinafter.

In the toothbrush 30, the head 31 thereof preferably has a diameter of between fifteen sixteenths of an inch and one and one sixteenth of an inch, and preferably in the nature of one inch; and preferably has an over-all length, between the outer faces of the brushes 33 and 34 of between fifteen sixteenths of an inch and one and one sixteenth of an inch, and, preferably in the nature of one inch. It has been found that with the head 31 having such dimensions it may be readily placed in operative position in a person's mouth.

Figure 32:
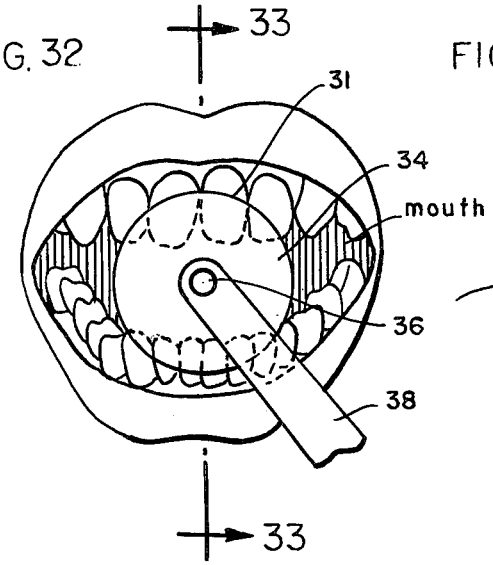
FIGS. 32–36 and 41 are views illustrating the use, in a person's mouth, of the brush shown in FIGS. 25–27.
Figure 33:
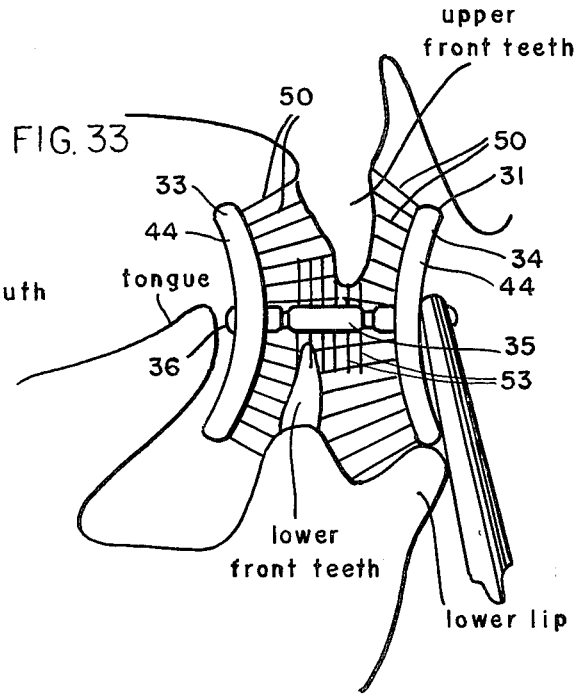

In the use of the toothbrush 30, the person brushing his teeth places the head 31 thereof into his mouth, and bites into the head 31 between the brushes 33 and 34, into engagement with the bristles 53 of the brush 35, in the manner illustrated in FIG. 32. When the head 31 is so positioned, the bristles 50 and 53 completely envelop the teeth in the area of the mouth where the head 31 is placed, as illustrated in FIG. 33. The person then moves the head 31 back and forth across the teeth and follows the teeth all of the way around from one side of the mouth to the other, reaching as far back as possible, all the time continuing the back and forth motion. It will be remembered that the brush 30 is an electric toothbrush wherein, the person using the same, by depressing the push-button 43, may cause the shaft 41 thereof, and, therefore, the head 31 to be vibrated. When so used, the tips of the bristles 50 and 53, impinging on the teeth and gums, not only are moved back and forth by the manual movement of the brush 30, but, also, are vibrated by the vibration of the shaft 41. This, it has been found, is highly effective in removing plaque from the teeth, the tips of the bristles, under such conditions, acting as small chisels or jack-hammers to effectively clean the plaque from the teeth.

Figure 34:
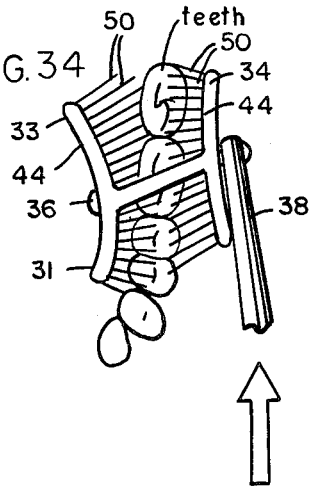
Figure 35:
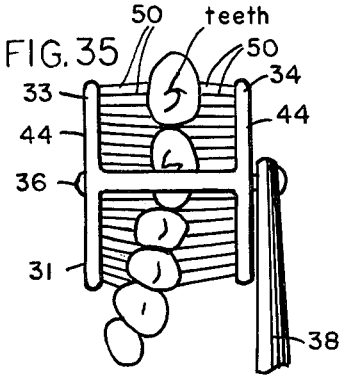
Figure 36:
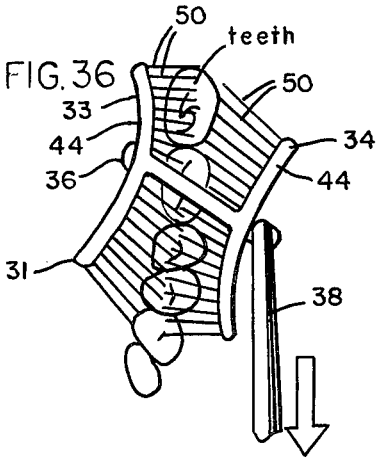
Figure 37:
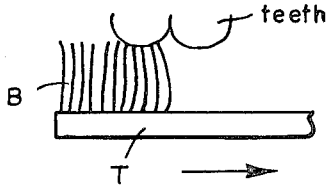
FIGS. 37–40 are views illustrating the use of a brush having bristles of the same length.
Figure 38:
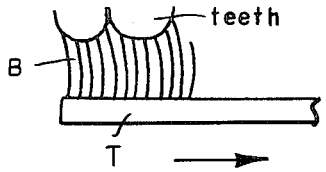
Figure 39:
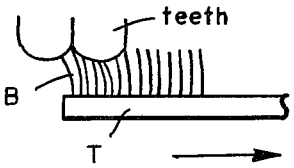

It will be remembered that in the preferred form of the brush 30, the bases 44 of the brushes 33 and 34 and the reinforcing members 46 therein are made of flexible material. This is effective to permit the brushes 33 and 34 to flex relative to the shaft 36, to follow the contours of the teeth, as illustrated in FIGS. 33–36. Also, it will be remembered that the shaft 36 is connected to the adapter 38 with a universal-joint type of connection, which permits oscillation of the shaft 36 relative to the adapter 38, as illustrated in FIGS. 28–31. This, it will be seen, is effective to permit the head 31 to turn and twist relative to the adapter 38, during movement of the head 31 around the person's mouth, as illustrated in FIGS. 34–36, such turning and twisting being possible in any direction, either vertically or horizontally, around the connection of the head 31 with the adapter 38, the bases 44 of the head 31 also bending and flexing, as illustrated in FIGS. 34–36 during such movement of the brush 30. This, it will be seen, is an entirely different mode of operation from that of the conventional toothbrush, such as the brush T illustrated in FIGS. 37–39, wherein the bristles B thereof merely move across the teeth with a sweeping action, rather than with the aforementioned chiseling action.

Figure 40:
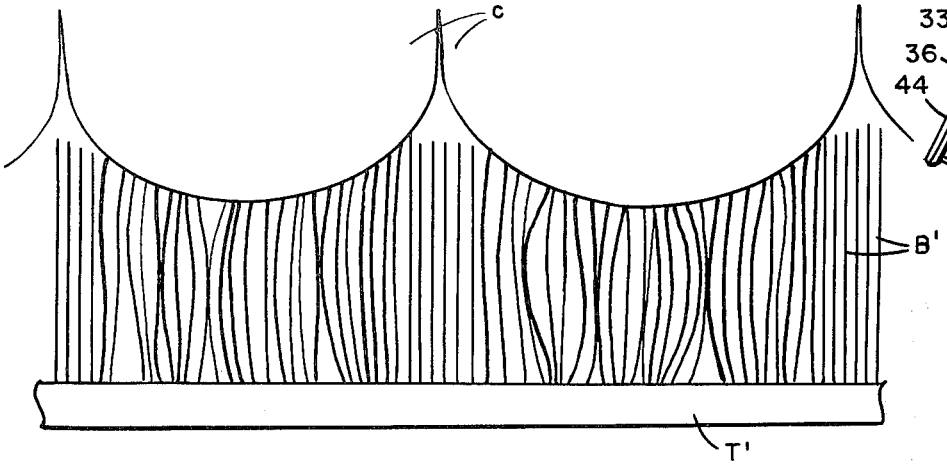
Figure 41:
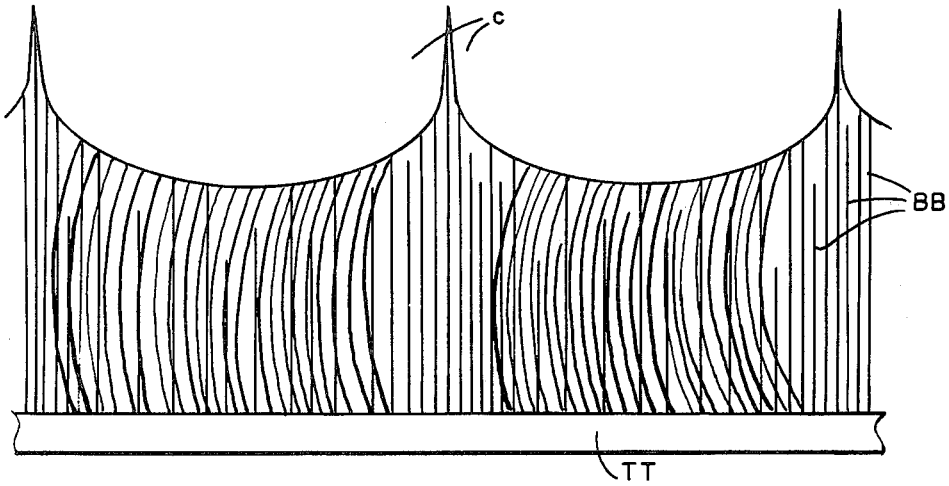

Also, with the brushes 33 and 34 constructed in the aforementioned preferred manner, wherein the adjacent bristles 50 thereof project different distances from the bases 44, the brushes 33 and 34 are effective to reach into spaces between and crevices in the teeth in a more highly effective manner than are brushes which embody bristles all having the same length. This is illustrated in FIGS. 40 and 41, wherein a brush T′ having bristles B′, which are all of the same length, has been pressed against teeth C, and, in FIG. 41, a brush TT, having bristles BB of different length, in the manner of the brushes 33 and 34, has been pressed against the teeth C. As illustrated in FIG. 40, when the bristles B′ of brush T′ are so pressed against the teeth, the bristles abutting the faces of the teeth tend to prevent the brush from approaching the teeth to a position wherein they effectively pass into the cracks and crevices between the teeth, whereas, in the use of a brush such as the brush TT, wherein the bristles BB thereof are of different lengths, the longer bristles are spaced from each other so that they do not create as great resistance to movement of the brush close to the teeth, thus permitting the bristles BB to effectively move into the crevices between the teeth.

Figure 42:
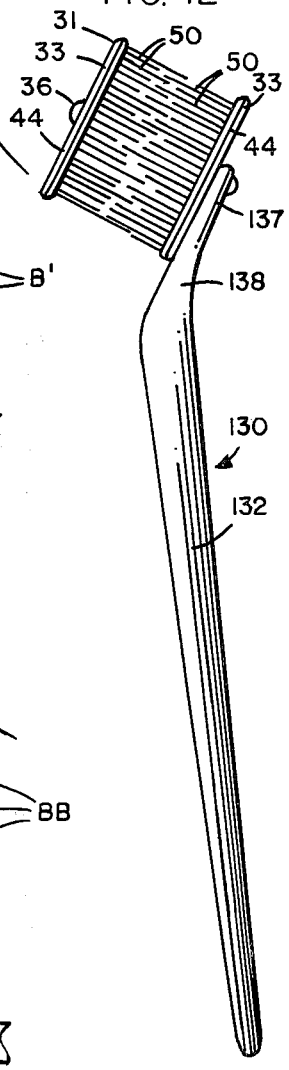
FIG. 42 is a view similar to FIG. 25, but showing a modified form of the present invention.

In FIG. 42 a modified form of the toothbrush 30 shown in FIGS. 25–27 is shown, and parts which are identical to parts shown in FIGS. 25–27 are indicated by the same reference numerals, and parts which are similar to parts shown in FIGS. 25–27, but which have been substituted therefor, are indicated by the same reference numerals with the prefix "1" added thereto.

Thus, it will be seen, that the brush 130, shown in FIG. 42, is identical in construction to the brush 30 shown in FIGS. 25≧27, except that it is completely manual in operation, merely having a solid handle 132 connected through the adapter 138 to the head 31, and relying on manual movement of the hand of the person using the brush 130 for movement of the head 31 back and forth along the teeth.

The operation of the brush 130 is the same as that of the brush 30, except that the vibration of the head 31 afforded by the brush 30 is lost so that the additional chiseling action afforded by the vibration of the bristles 50 and 53 afforded by the power unit in the brush 30 is not afforded in the use of the brush 130.

From the foregoing, it will be seen that the present invention affords a novel method for making brushes.

In addition, it will be seen that the present invention affords novel brushes.

Also, it will be seen that the present invention affords novel toothbrushes, which are practical and efficient in operation, and which may be readily and economically produced commercially.

Also, it will be seen that the present invention affords a novel method of making toothbrushes.

Thus, while I have illustrated and described the preferred embodiments of my invention, it is to be understood that these are capable of variation and modification and I therefore do not wish to be limited to the precise details set forth, but desire to avail myself of such changes and alterations as fall within the purview of the following claims.

I claim:

1. The method of manufacturing a brush comprising
   a. forming an elongated strip comprising
      (1) an elongated backing sheet, and
      (2) a plurality of elongated filaments secured to one face of said sheet
         (a) in transversely extending relation thereto, and
         (b) with one end of each of said filaments projecting outwardly from the same longitudinal edge of said sheet,
   b. securing said one end of said filaments to a supporting member, and
   c. removing said backing sheet from said filaments to afford bristles projecting outwardly from said supporting member.
2. The method defined in claim 1, and which includes
   a. longitudinally wrapping said strip upon itself prior to securing said one end of said filaments to said supporting member.
3. The method defined in claim 1, and which includes
   a. longitudinally wrapping said strip into a round spiral prior to securing said one end of said filaments to said supporting member.
4. The method defined in claim 1, and which includes
   a. longitudinally wrapping said strip upon itself into an oblong shape prior to securing said one end of said filaments to said supporting member.
5. The method of manufacturing a brush comprising
   a. forming a plurality of elongated strips, each of said strips comprising
      (1) an elongated backing sheet, and
      (2) a plurality of elongated filaments secured to one face of said sheet
         (a) in transversely extending relation thereto, and
         (b) with one end of each of said filaments projecting outwardly from one longitudinal edge of said sheet,
   b. assembling said strips in parallel juxtaposition to each other with said one end of all of said filaments projecting in the same direction from the resulting assemblage,
   c. securing said one end of said filaments to a supporting member, and
   d. removing all of said backing sheets from said filaments to afford bristles projecting outwardly from said supporting member.
6. The method of manufacturing a brush comprising
   a. forming an elongated strip comprising
      (1) an elongated backing sheet having an adhesive coating on one face thereof, and (2) a plurality of elongated filaments adhesively secured by said coating to said one face
(a) in transversely extending relation to the length of said sheet, and
(b) with one end of each of said filaments projecting outwardly from the same one longitudinal edge of said sheet, b. disposing said strip into a predetermined shape with said one end of all of said filaments projecting in the same direction, c. adhering a base to said one end of all of said filaments, and d. removing said backing sheet from said filaments to afford free bristles projecting outwardly from said base.

7. The method defined in claim 6, and in which a. said shape comprises a coil of substantially round transverse cross-sectional shape.

8. The method defined in claim 7, and in which a. said coil has an opening extending substantially axially therethrough.

9. The method defined in claim 6, and in which a. said shape comprises a coil of substantially oblong transverse cross-sectional shape.

10. The method defined in claim 6, and in which a. said shape is substantially flat, uniplanar.

11. The method defined in claim 10, and which includes a. so forming a plurality of said strips, b. disposing all of said strips into said shape, which comprises an assemblage of said strips with said strips disposed in substantially parallel juxtaposition to each other, c. simultaneously adhering said base to all of said filaments of all of said strips, and d. removing all of said backing sheets from said filaments.

12. The method defined in claim 11, and which includes a. rolling said assemblage, transversely to the length thereof and after said removal of said backing sheets, into a tube
(1) with opposite longitudinal edges of said assemblage in abutting relation to each other, and
(2) with said filaments projecting radially outwardly from said base, and b. adhering the edges of said base at said opposite longitudinal sides of said assemblage to each other.

13. The method defined in claim 12, and which includes a. transversely cutting said rolled and adhered tube into predetermined lengths.

14. The method defined in claim 6, and which includes a. applying a solvent to said adhesive coating before removing said backing sheet from said filaments.

15. The method defined in claim 6, and which includes a. cutting the other longitudinal edge portion of said sheet and said filaments secured thereto into a zigzag pattern extending longitudinally of said strip.

16. The method defined in claim 6, and in which a. said filaments of said strip extend longitudinally substantially perpendicular to the length of said backing sheet.

17. The method defined in claim 6, and in which a. said filaments of said strip extend longitudinally substantially at an acute angle to the length of said backing sheet.

18. The method defined in claim 6, and which includes a. forming enlarged portions on all of said one ends of all of said filaments prior to adhering said base thereto.

19. The method defined in claim 18, and in which a. said filaments comprise nylon, and b. said enlarged portions are formed by passing said one end of said filaments through flame.

20. The method defined in claim 6, and in which a. said base is flexible.

21. The method defined in claim 20, and in which a. said base is adhered to said one end of said filaments by
(1) placing an elastomeric material into a form in molten condition,
(2) placing said one end of said filaments in said molten material, and
(3) permitting said elastomeric material to set into a solid.

22. The method defined in claim 21, and which includes a. placing a reinforcing member in said form with said molten material in position to be embedded in said elastomeric material when the latter has so set into a solid.

23. The method defined in claim 21, and in which a. said reinforcing member comprises a disk-shaped portion having openings therethrough, and b. said molten material flows through said openings and sets therein.

24. The method defined in claim 23, and in which a. said reinforcing member is resilient and flexible.

25. The method defined in claim 24, and in which a. said reinforcing member comprises rubber.

26. The method defined in claim 25, and in which a. said base comprises silicone.

27. The method defined in claim 6, and which includes a. mounting said base in a hard cover member disposed on the opposite side thereof from said bristles.

28. The method of manufacturing a brush comprising a. adhesively securing a plurality of elongated filaments to an adhesively coated face of an elongated sheet in parallel spaced relation to each other and in transversely extending relation to the length of said sheet, b. forming an elongated strip by
(1) removing one longitudinal edge portion of said sheet from said filaments,
(2) longitudinally severing said sheet and simultaneously severing said filaments secured thereto in inwardly spaced, parallel relation to said one edge portion, and
(3) thereby afford
(a) an elongated backing sheet having an adhesive coating on one face thereof, and
(b) a plurality of elongated filaments adhesively secured to said last mentioned one face
(1') in transversely extending relation to the length of said backing sheet, and
(2') with one end of each of said last mentioned filaments projecting outwardly from the same one longitudinal edge of said sheet, c. disposing said strip into a predetermined shape with said one end of all of said last mentioned filaments projecting in the same direction,
d. placing an elastomeric material into a form in molten condition
e. placing said one end of said last mentioned filaments in said molten material,
f. permitting said elastomeric material to set into a solid supporting member,
g. applying a solvent to said backing sheet, and
h. removing said backing sheet from said filaments to afford free bristles projecting outwardly from said supporting member.

29. The method defined in claim 28, and which includes
a. longitudinally severing the longitudinal edge portion of said strip remote from said one longitudinal edge portion in a zig-zag pattern prior to disposing said strip into said predetermined shape.

30. A toothbrush comprising
a. an elongated handle,
b. a shaft mounted in said handle and having an end portion projecting outwardly from said handle,
c. two brushes,
d. each of said brushes comprising
(1) a base support member comprised of resilient, yieldable material and having two oppositely disposed faces, and
(2) bristles projecting outwardly from one of said faces, with said bristles on each of said bases spaced from each other along a substantially spiral-shaped row, and adjacent bristles in each of said rows projecting different distances from said base support member on which said bristle are mounted, and said bristles on one of said base support member extending into abutting engagement with said bristles on said other of said base support member,
e. said brushes being rotatably mounted on said shaft with said bristles on said two brushes facing toward each other, and
f. said shaft being articulatedly mounted in said handle for transverse movement relative thereto through an acute angle.

31. A toothbrush as defined in claim 30, and in which
a. said shaft is articulatedly mounted in said handle for transverse movement in all directions relative to the longitudinal axis of said shaft.

32. A toothbrush as defined in claim 30, and in which
a. said bases are flexible for deflection toward and away from each other.

33. A toothbrush as defined in claim 32, and in which
a. said bases comprise resilient, yieldable material.

34. A toothbrush as defined in claim 33, and in which
a. said bristles are individually embedded in said bases in spaced relation to each other.

35. A toothbrush as defined in claim 34, and in which
a. said bases comprise an elastomeric material.

36. A toothbrush as defined in claim 35, and in which
a. said material comprises silicone.

37. A toothbrush as defined in claim 30, and in which
a. each of said bases includes an elongated sleeve
(1) projecting from said one face thereof through said bristles thereon, and
(2) mounted on said shaft in surrounding relation thereto.

38. A toothbrush as defined in claim 37, and in which
a. said sleeves of said brushes are disposed in spaced relation to each other.

39. A toothbrush as defined in claim 38, and
a. which includes
(1) another brush having
(a) a tubular shaped base, and
(b) bristles projecting radially outwardly from said last mentioned base, and
b. in which
(1) said other brush is mounted on said shaft
(a) in surrounding relation thereto, and
(b) between said sleeves.

40. A toothbrush as defined in claim 39, and in which
a. said base of said other brush comprises resilient, yieldable material.

41. A toothbrush as defined in claim 34, and in which
a. each of said bases includes a reinforcing member
b. each of said reinforcing members comprises
(1) a disk having an opening extending laterally therethrough, and
(2) a tubular portion
(a) disposed in axial alignment with said opening, and
(b) extending into said bristles on the respective one of said bases, and
c. said shaft is disposed in and extends axially through said tubular portions and said openings.

42. A toothbrush as defined in claim 41, and in which
a. said tubular portions are disposed in axially spaced relation to each other on said shaft.

43. A toothbrush as defined in claim 42, and
a. which includes
(1) another brush having
(a) a tubular shaped base, and
(b) bristles projecting radially outwardly from said last mentioned base, and
b. in which
(1) said other brush is mounted on said shaft
(a) in surrounding relation thereto, and
(b) between said tubular portions.

44. A toothbrush as defined in claim 43, and in which
a. said bases of all of said brushes and said reinforcing members
(1) are flexible, and
(2) comprise resilient, flexible material.

45. A toothbrush as defined in claim 44, and in which
a. said shaft is substantially rigid.

46. A toothbrush as defined in either claim 34, 40 or 45, and in which
a. said handle comprises a vibratory unit for vibrating said shaft and thereby vibrating said brushes mounted on said shaft.

47. The method in accordance with claim 1 wherein said securing one end of said filaments to a supporting member includes the further steps of hardening said supporting member and attaching one end of said filaments to said hardened supporting member by an adhesive material.

48. A toothbrush comprising
a. an elongated handle,
b. a shaft mounted in said handle and having an end portion projecting outwardly from said handle,
c. two brushes, each of said brushes comprising
(1) a base comprised of resilient, yieldable material having two oppositely disposed faces, with said faces being flexible for deflexion toward and away from each other, and (2) bristles projecting outwardly from one of said faces, with said bristles individually embedded in said bases in spaced relation to each other and in which adjacent ones of said bristles in each of said two brushes project different distances from said bases in which they are embedded, d. each of said bases includes a reinforcing member comprised of a disc having an opening extending laterally therethrough and a tubular portion disposed in axial alignment with said opening and extending into said bristles on respective one of said bases;

e. another brush having a tubular shaped base and bristles projecting radially outwardly from said last mentioned base and wherein said other brush is mounted on said shaft in surrounding relationship thereto and between said tubular portions, with said tubular portions disposed in axially spaced relation to each other on said shaft, f. all of said bases and all of said brushes and said reinforcing members are flexible and comprise resilient, flexible material, g. said brushes being rotatably mounted on said shaft with said bristles on said two brushes facing each other, and h. said shaft disposed in and extending axially through said tubular portions and said openings and being articulatedly mounted in said handle for transverse movement relative thereto through an acute angle.

49. A toothbrush comprising a. an elongated handle, b. a shaft mounted in said handle and having an end portion projecting outwardly from said handle, c. two brushes, d. each of said brushes comprising (1) a base comprised of resilient, yieldable material and having two oppositely disposed faces, with said faces being flexible for deflection toward and away from each other, and (2) bristles projecting outwardly from one of said faces, with said bristles individually embedded in said bases in spaced relation to each other and disposed in rows with adjacent ones of said bristles in each of said rows projecting different distances from said bases on which said bristles are mounted, e. said brushes being rotatably mounted on said shaft with said bristles on said two brushes facing toward each other, and f. said shaft being articulatedly mounted in said handle for transverse movement relative thereto through an acute angle.

50. A toothbrush comprising a. an elongated handle, b. a shaft mounted in said handle and having an end portion projecting outwardly from said handle, c. two brushes, d. each of said brushes comprising (1) a base comprised of resilient, yieldable material and having two oppositely disposed faces, with said faces being flexible for deflection toward and away from each other, and (2) bristles projecting outwardly from one of said faces, with said bristles on each of said bases spaced from each other along a substantially spiral-shaped row, and adjacent bristles in each of said rows projecting different distances from the base on which said bristles are mounted, e. said brushes being rotatably mounted on said shaft with said bristles on said two brushes facing toward each other, and f. said shaft being articulatedly mounted in said handle for transverse movement relative thereto through an acute angle.

* * * * *